US005220855A

United States Patent [19]

Leung et al.

[11] Patent Number: 5,220,855

[45] Date of Patent: Jun. 22, 1993

[54] CORKSCREW

[76] Inventors: Denis T. L. Leung, Flat D, 3/F., 3 Cheung Sha Wan Road; Calvin T. T. Leung, Flat D, 3/F., Cheung Sha Wan Road, both of Kowloon, Hong Kong

[21] Appl. No.: 818,859

[22] Filed: Jan. 10, 1992

[51] Int. Cl.[5] ..... B67B 7/04

[52] U.S. Cl. ..... 81/3.29

[58] Field of Search ..... 81/3.29, 3.07, 3.35, 81/3.36, 3.29, 3.45

[56] References Cited

U.S. PATENT DOCUMENTS 4,570,512 2/1986 Pracht ..... 81/3.29

FOREIGN PATENT DOCUMENTS 9113364.5 6/1991 United Kingdom .

*Primary Examiner*—Roscoe V. Parker

*Attorney, Agent, or Firm*—Dick and Harris

[57] ABSTRACT

The present disclosure relates in general to a corkscrew and in particular to a corkscrew with a simplified arrangement to pierce into a cork and extract it from a bottle by way of a more effective member for centering the helical body of the corkscrew with respect to the cork.

3 Claims, 5 Drawing Sheets

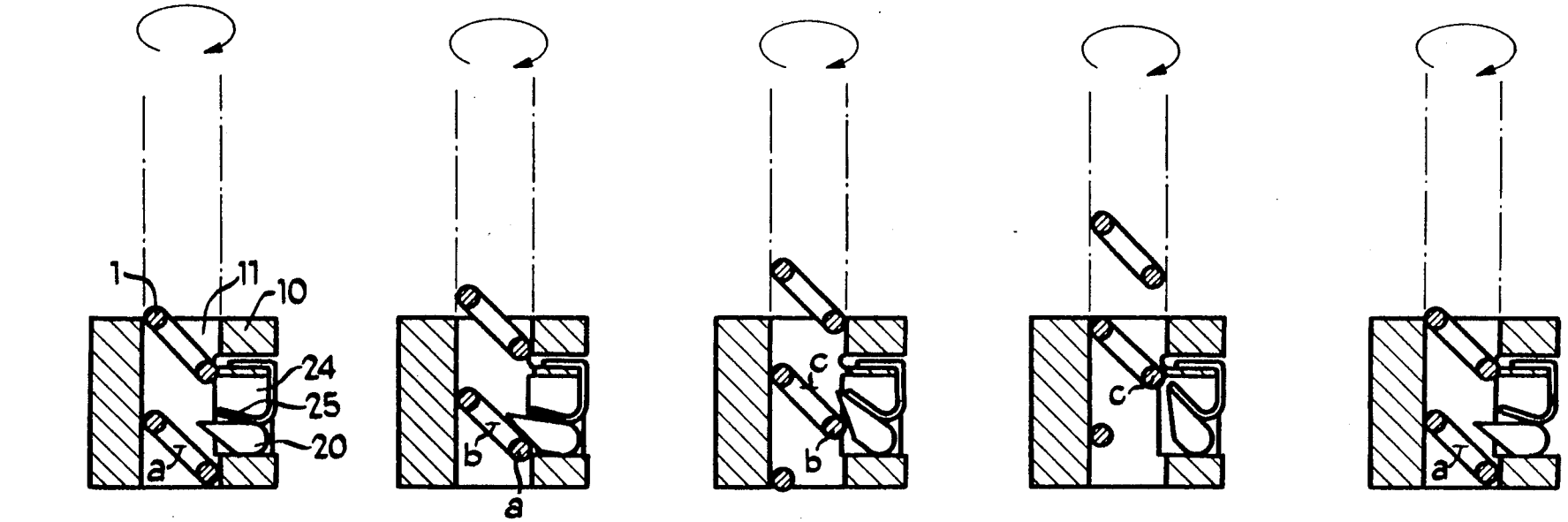
Fig 6 (1)
Fig 6 (2)
Fig 6 (3)
Fig 6 (4)
Fig 6 (5)

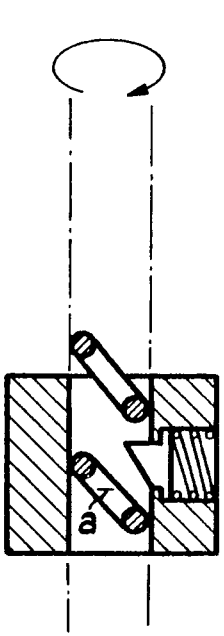
Fig 11 (5)
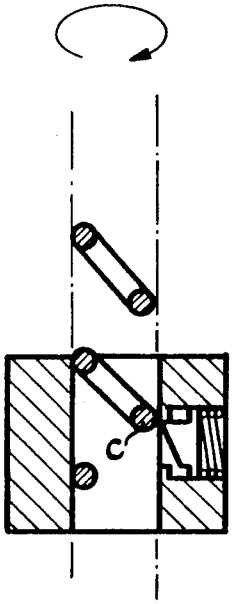
Fig 11 (4)
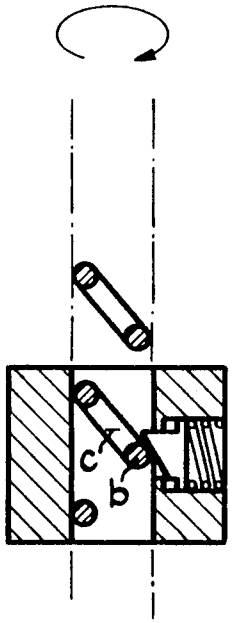
Fig 11 (3)
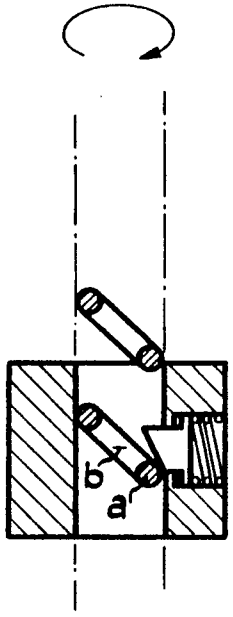
Fig 11 (2)
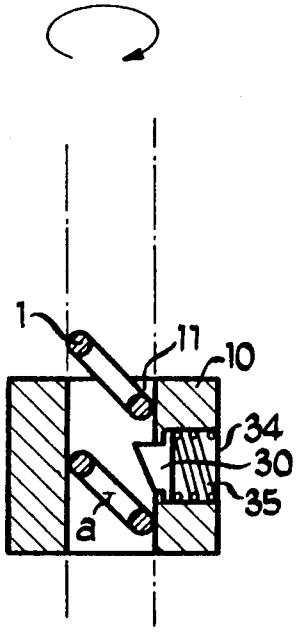
Fig 11 (1)

CORKSCREW

BACKGROUND OF THE INVENTION

The present invention relates in general to a corkscrew and in particular to a corkscrew with a simplified arrangement to pierce into a cork and extract it from a bottle by way of a more effective means for centering the helical body of the corkscrew with respect to the cork by simple single-direction turning motion.

Corkscrews are well known in the art. The marked differences between the existing corkscrews are in their mechanical structures. Some do not provide centering means at all while others, though providing centering means, position such centering means too far above the cork to be extracted, to function well.

U.S. Pat. No. 4,570,512, to Pracht introduced a spring-loaded piston housed in a sleeve-like body. At its position of rest, the corkscrew blade is completely shielded the corkscrew is believed to be safe and not likely to cause blade injuries with its tip. Unfortunately this may not be so, since the sleeve-like body is only weakly held in position by a releasing spring, and unconscious withdrawal of this sleeve-like body when being pressed accidentally or unknowingly can cause injuries to a user. This type of corkscrews is even more dangerous than that with exposed corkscrew blades as to which users normally pay special attention.

UK Patent Application No. 9113364.5, filed by the present inventors at the filing Date of Jun. 20, 1991, discloses an improved corkscrew configured to avoid the possible injuries to users and to center the corkscrew in respect to the cork, and including a simplified housing means and a centering means with a track means being formed at the central portion thereof for receiving the helical body of the corkscrew means passing slidably therethrough. In operation, the centering means is initially located at its lowest position in the housing means just on top of the bottle to be uncorked. While the helical body is turned clockwise the helical body shall pierce into the cork with the axis of the helical body substantially along or parallel closely to the axis of the cork owing to that the centering means is very close to the cork so as to avoid the departure of the helical body from the line substantially along or parallel closely to the axis of the cork during piercing. Upon continued rotation, the helical body shall penetrate through the cork. The centering means as well as the cork shall move up along the helical body till the extraction of the cork from the bottle is completed when the centering means together with the extracted cork move to the upper portion in the housing means.

It has been brought to the inventors' notice that in the operation of the improved corkscrew disclosed in the UK patent application No. 9113364.5 the centering means should start to move up along the helical body together with the penetrated cork when the helical body comes to the lowest position and is further turned while at this position. However, it is found that at any moment during the downward movement of the helical body to the lowest position if the helical body stands for some reason and continues being turned in situ, the centering means shall start to move up along the helical body immediately and the cork remain unpenetrated in situ. After that, as soon as the helical body continues being pressed and turned in the original direction, the cork shall be penetrated through and moved up with a gap between the cork and the centering means when the helical body comes to the lowest position and continues being turned in the same direction. The gap between the cork and the centering means will appear more or less during the turning of the helical body in the same direction even if there is no stop during the downward movement of the helical body because of the loss of tangential friction (slippage) between the cork and the internal surface of the bottle neck. This loss of tangential friction causes the cork to rotate along with the helical body occasionally and move up slower than the centering means moves up. In other words, they would not move up synchronously or simultaneously, so that the gap would always exist between the cork and the centering means. As a result of the undesirable gap, the housing means has to be long enough to contain the centering means, the extracted cork and the gap caused from time to time. Sometimes, the gap caused is so large that the cork may not be fully extracted from the bottle when the centering means moves up to the highest position and terminates the operation.

In view of the foregoing, it is an object of the present invention to provide an improved centering means to eliminate the gap between the extracted cork and the centering means while they are moving up such that the housing means needs no additional length to contain the undesirable gap and the cork will certainly be extracted fully into the housing means.

It is another object of the present invention to provide a corkscrew with less danger but more efficient and reliable to use and simple structure to manufacture.

BRIEF DESCRIPTION OF THE DRAWING

Other and further objects features and advantages of the present invention will appear more fully from the following description taken in connection with the accompanying drawings wherein:

FIGS. 6(1)–6(5) show exploded operational views of an embodiment of the ratcheting one-way driving means while the helical body (1) is being turned clockwise.

FIGS. 11(1)–11(5) show exploded operational views of another embodiment of the ratcheting one-way driving means while the helical body (1) is being turned clockwise.

DESCRIPTION OF THE PREFERRED EMBODIMENT

Figure 1:
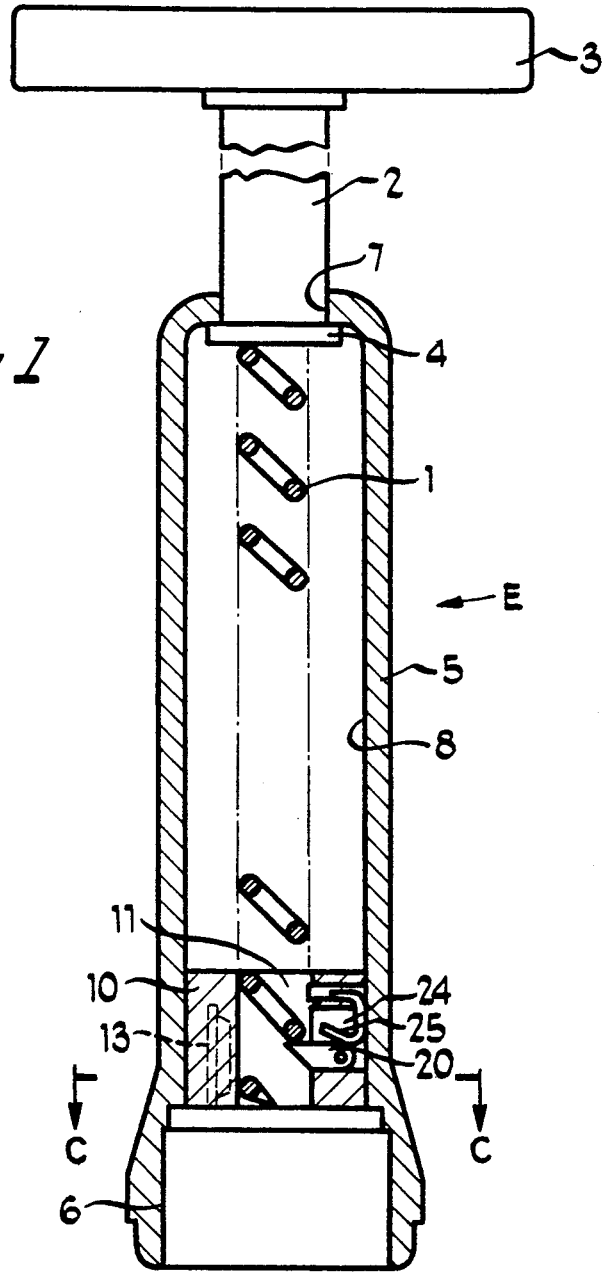
FIG. 1 is a longitudinal cross-sectional view of the preferred embodiment of the present invention.
Figure 2:
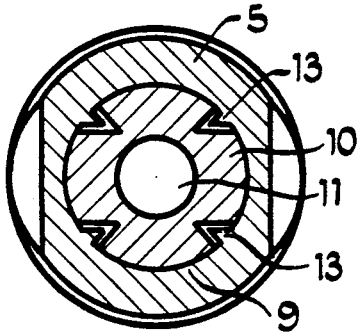
FIG. 2 is a cross-sectional view taken on line c—c of FIG. 1.
Figure 13:
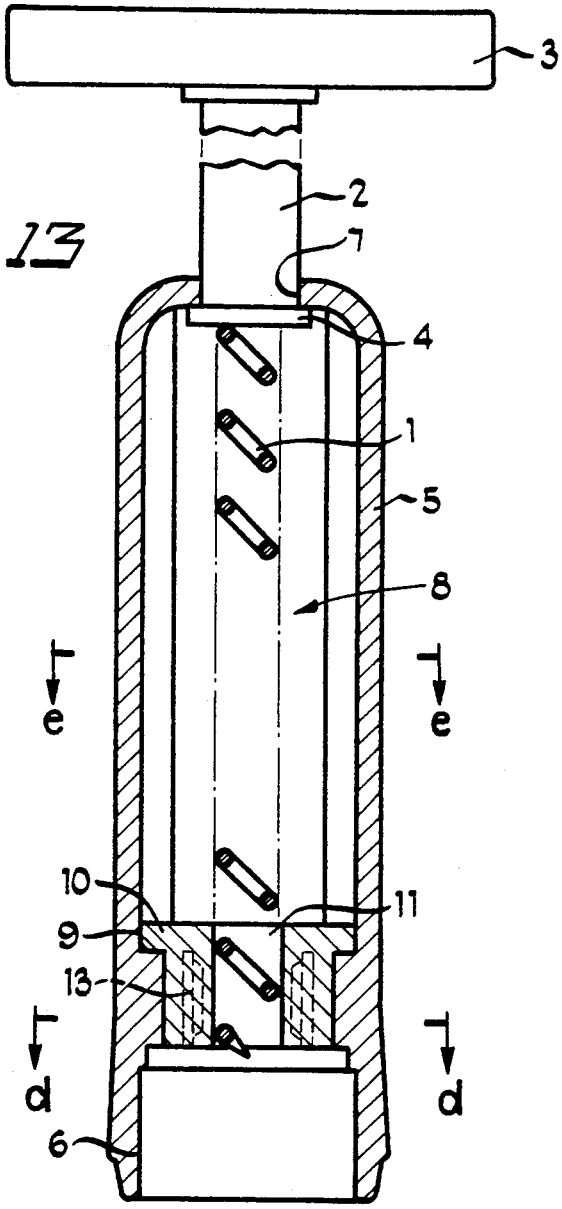
FIG. 13 is a longitudinal cross-sectional view in the direction of the arrow E in FIG. 1.
Figure 15:
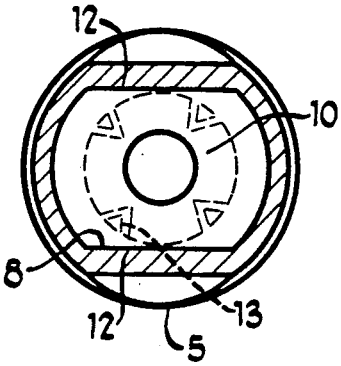
FIG. 15 is a cross-sectional view taken on line e—e of FIG. 13.
Figure 14:
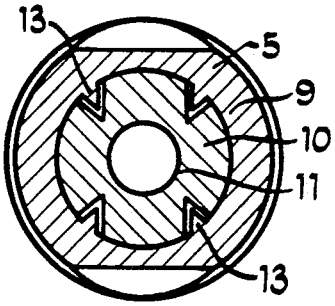
FIG. 14 is a cross-sectional view taken on line d–d of FIG. 13.

Referring now to the drawings, wherein like reference characters designate like or corresponding parts throughout the several views, FIG. 1 illustrates an embodiment in accordance with the present invention which comprises a helical body 1 having a fixed end and a free end being a pointed tip for piercing into the cork; a shaft means 2 having an upper end and a lower end, the axis thereof being aligned with the axis of the helical body 1 of the corkscrew, the fixed end of the helical body 1 being firmly fixed onto lower end of the shaft means 2; a handle means 3 being secured at the upper end of the shaft means 2 for facilitating the turning of the helical body by hand; a flange means 4 being integrally provided at the lower end of the shaft means 2 for limiting the upward movement of the shaft means 2; a centering means 10, being of a configuration 12 for preventing from rotation thereof (FIGS. 13, 15), having at the central portion thereof a central passageway means 11 extending generally longitudinally therethrough for receiving the helical body 1 passing slidably through, and the passage-way means 11 being of the same diameter with clearance as the outside diameter of the helical body 1 and substantially coaxial with the axis of the helical body 1 so that when the free end of the helical body 1 has passed through the passageway means 11, the pointed tip of the free end shall be substantially aimed at the central portion of the cork and the axis of the helical body 1 shall be substantially along or parallel closely to the axis of the cork to be extracted from a bottle; and an elongated housing means 5 having a bottle-engaging means 6 at the lower end thereof for being emplaced on the mouth of the corked bottle in a substantially coaxial state. The housing means 5 includes a guide means 7 at the upper end thereof for receiving and guiding the shaft means 2 during axial movement thereof. There is a support means 9 formed at the lower portion inside the housing means 5 for supporting the centering means 10 thereon such that the lower face of the centering means 10 abuts on the top of the mouth of the bottle when the apparatus is emplaced properly onto the mouth of the bottle to be uncorked.

The internal wall 8 of the housing means 5 is so shaped to fit the contour 12 of the centering means 10 (FIGS. 13 and 15) that the centering means 10 is allowed to move along the longitudinal axis of the housing means 5 without rotation.

For instance, while the centering means 10 may have a round configuration with at least one contour 12 thereon (FIGS. 13 and 15), the internal wall 8 of the housing means 5 should be in the corresponding shape to fit with these contours 12. Thus, the centering means 10 can be moved up and down without any rotative movement when the helical body 1 passing through the centering means 10 is rotated.

The housing means 5 is long enough to contain the shaft means 2 and the centering means 10 plus the cork to be extracted as well as the bottle engaging means 6 while the shaft means 2 is in the lowest position, and to contain the whole helical body of the corkscrew means 1 plus the bottle engaging means 6 while the shaft means 2 is in the highest position.

The shaft means 2 is of a length such that when the flange means 4 is engaged to so limit upward movement of the shaft means 2 together with the helical body 1, the free end of the helical body 1 shall be ready for piercing the cork to be extracted from a bottle; when the handle means 3 is engaged to so limit downward movement of the shaft means 2 the free end of the helical body 1 penetrates substantially deep enough into the cork whereby the cork may move upwardly along the helical body 1 as the helical body 1 continues to be turned to withdraw the cork from the bottle.

Figure 4:
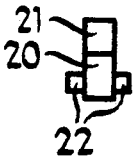
FIG. 4 is a front view of the pawl-like means (20) in the direction of the arrow A in FIG. 3.
Figure 3:
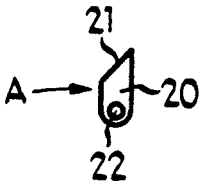
FIG. 3 is a side view of the pawl-like means (20).
Figure 5:
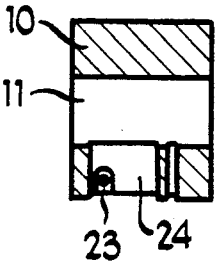
FIG. 5 is a longitudinal cross-sectional view of an embodiment of the centering means (10).

According to the present invention, a ratcheting means for one-way driving of the centering means 10 by the helical body 1 is provided. In one embodiment of the present invention, the ratcheting means for one-way driving comprises a pawl-like means 20 having a decline 21 at one end and a retaining pivot means 22 at the other end thereof (FIGS. 3 and 4). At the wall of the passageway means 11, as shown in FIG. 5, an opening 24 is provided for receiving the pawl-like means 20, a pivot bearing 23 is provided in the opening 24 for pivotally engaging with the retaining pivot means 22 of the pawl-like means 20, and a spring means 25 is provided in the opening 24 for keeping the pawl-like means 20 normally stretched out to the utmost stretched position where the pawl-like means 20 abuts against the wall of the opening 24. At the beginning of operation, the apparatus is emplaced with the bottle engaging means 6 properly onto the mouth of the bottle to be uncorked and held firmly by user's one hand. The centering means 10 with the pawl-like means 20 being rested upon by some point on the downside of the helical body 1 is initially positioned on the support means 9 in the housing means 5. At its initial position the helical body 1, with the handle means 3 at its highest position, resting on the pawl-like means 20, is prevented from dropping down and thus the pointed tip of the free end of the helical body 1 shall not protrude from the housing means 5 unless the helical body 1 is being pressed down and simultaneously turned clockwise. The handle means 3 in its highest position is then gently pressed down and turned clockwise by the user's other hand, the helical body 1 passing through and guided by the passageway 11 of the centering means 10 will pierce into the cork with the axis thereof substantially along or parallel closely to the axis of the cork. Because the centering means 10 is very close to the cork, the helical body 1 is kept in straight and coaxial position without departure from the line substantially along or parallel closely to the axis of the cork during piercing.

It should be pointed out that while the helical body 1 is being turned clockwise, the pawl-like means 20 is periodically being pressed and pushed into the opening 24 by the helical body 1, so that the centering means 10 is not driven by the helical body 1 to move up from the lowest position in this clock-wise turning period, no matter whether the helical body 1 is axially immobile while being turned clockwise at some position or is moving down smoothly while being turned clockwise to pierce into the cork. The operation of the pawl-like means 20 is illustrated in FIG. 6 (1)–(5). In FIG. 6 (1), at this moment there is no point of helical body 1 in contact with the pawl-like means 20, which is normally stretched out to the utmost position. The pawl-like means 20 abuts the bottom of the opening 24 by the spring means 25 while the helical body 1 is being turned clockwise and point A of helical body 1 is coming to push the pawl-like means 20. In FIG. 6 (2), point a is in contact with the angled surface 21 (see FIGS. 3 and 4) of the pawl-like means 20 and is pushing the pawl-like means 20 pivotally moving into the opening 24 while the helical body 1 is being turned clockwise for some degrees and point b is coming to push the pawl-like means 20 further into the opening 24. In FIG. 6 (3), point b is in contact with the angled surface 21 of the pawl-like means 20 and is pushing the pawl-like means 20 pivotally in a clockwise direction, as seen in FIGS. 6 (1)–(5), further into the opening 24 while the helical body 1 is being turned further clockwise and point c is coming to push the pawl-like means 20 further into the opening 24. In FIG. 6 (4), point c is in contact with the angled surface 21 of the pawl-like means 20 and is pushing the pawl-like means 20 pivotally fully into the opening while the helical body 1 is being turned further clockwise and point A again approaches angled surface 21. In FIG. 6 (5), the pawl-like means 20 has been released from point c and returned to the utmost stretched position where the pawl-like means 20 abuts against the wall of the opening 24 by the force of the spring means 25 while the helical body 1 is being turned clockwise for another circulations and point A is ready to touch and push the pawl-like means 20 once more.

When the helical body 1 has penetrated deep enough into the cork and come to its lowest position in respect to the housing means 5, the cork shall move up along the helical body 1 so long as the helical body 1 continues being turned clockwise while staying at its lowest position. The cork, while moving up, shall abut and shove on the centering means 10 to move up along therewith. In the meantime, the pawl-like means 20 shall still be periodically pushed into the opening 24 by the helical body 1 until the cork is extracted from the bottle into the housing means 5. The centering means 10 at this moment has been shoved by the cork to move up to the position to nearly abut the flange means 4 of the shaft means 2. Thus, the extraction of the cork from the bottle has been completed.

Figure 7:
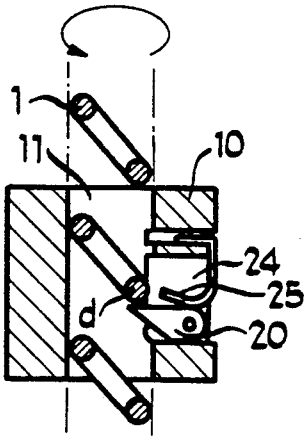
FIG. 7 shows the one-way driving function of the embodiment in FIG. 6 as the helical body (1) is being turned counter clockwise.

To extrude the cork from the housing means 5, the operation of the apparatus provided by the present invention is now simply needed to turn the helical body 1 counterclockwise by means of the handle means 3. As shown in FIG. 7, the pawl-like means 20 shall not be pushed into the opening 24 while the helical body 1 is being turned counter-clockwise because the helical body 1 is blocked upon some point thereof by the pawl-like means 20 in its utmost stretched position, where the pawl like means 20 abuts against the bottom of the opening 24, for example, on point d at the moment as shown in FIG. 7. In this way, while the helical body 1 continues being turned counter-clock-wise, owing to the blocking of the pawl-like means 20 against the bottom of the opening 24, the centering means 10 shall be driven down with the lower surface of the helical body 1 abutting on the pawl-like means 20 against the bottom of the opening 24 and shall shove on the cork to extrude it from the housing means 5. Further turning counter-clockwise of the helical body 1 shall drive the cork down by the centering means 10 along the helical body 1, and the cork shall be extruded from the housing means 5 and drop off.

It must be noted that by means of the pawl-like means 20 no matter whether the helical body 1 is axially immobile while being turned clockwise at some position or is moving down while being turned clockwise to pierce into the cork, the centering means 10 shall never be driven to move upwards through clockwise turning of the helical body 1 and shall only be shoved to move upwardly by the upwardly up moving cork per se, so that the gap between the centering means 10 and the cork shall be certainly avoided. Thus, the pawl-like means 20 functions as a so-called ratcheting one-way driving means and attains the objects of the present invention.

To prevent rotation of the cork when it is extracted from the bottle into the housing means 5, sharp-edged ribs 13 are provided inside the support means 9 at the lower portion of the housing means 5, which are integrally formed with the inner circumference of the support means 9 (see FIG. 1, 2, 13 and 14).

Figure 8:
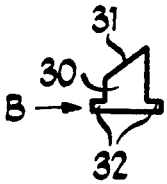
FIG. 8 is a side view of a spring bolt means (30).
Figure 9:
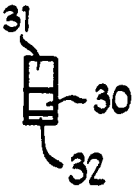
FIG. 9 is a front view of the spring bolt means (30) in the direction of the arrow B in FIG. 8.
Figure 10:
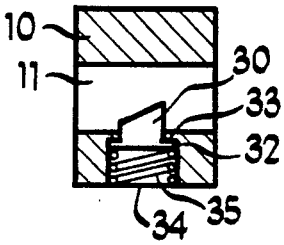
FIG. 10 is a longitudinal cross-sectional view of another embodiment of the centering means (10).

In another embodiment of the present invention, the means for ratcheting one-way driving comprises a spring bolt means 30 having an angled surface 31 at one end and a retaining means 32 at the other end thereof (FIGS. 8 and 9). At the wall of the passageway means 11, as shown in FIG. 10, an opening 34 is provided for receiving the spring bolt means 30, a shoulder means 33 is provided at the inner end of the opening 34 for engaging the retaining means 32 of the spring bolt means 30, and a spring means 35 is provided for keeping the spring bolt means 30 normally stretched out to the utmost position where the spring bolt means 30 is retained by the retaining means 32 engaged with the shoulder means 33. This sort of one-way driving means, nanely the spring bolt means 30, shall function as good as the embodiment described above. While the helical body 1 is being turned clockwise the spring bolt means 30 is periodically being pressed and pushed down into the opening 34 by the helical body 1 so that the centering means shall not be driven by the helical body 1 to move up from its lowest position in the housing means 5 during the clockwise turning period, no matter whether the helical body 1 would be axially immobile while being turned clockwise at some position or is moving down smoothly while being turned clockwise to pierce into the cork. The operation of the spring bolt means 30 is illustrated in FIG. 11(1)–(5). In FIG. 11(1), at this moment there is no point of the helical body 1 in contact with the spring bolt means 30 while the helical body 1 is being turned clockwise and point a is coming to push the spring bolt means 30 which is now in the utmost stretched position by the force of the spring means 35. In FIG. 11(2), point a is in contact with the angled surface 31 of the spring bolt means 30 and is pushing down the spring bolt means 30 into the opening 34 while the helical body 1 has been turned further clockwise and point b is coming to push the spring bolt means further into the opening 34. In FIG. 11(3), point b is in contact with the angled surface 31 of the spring bolt means 30 and is pushing down the spring bolt means 30 further into the opening 34 while the helical body 1 has been turned further clockwise and point c is coming to push the spring bolt means 30 further into the opening 24. In FIG. 11(4), point c is in contact with the angled surface 31 of the spring bolt means 30 and is pushing down the spring bolt means 30 fully into the opening 34 while the helical body 1 has been turned further clockwise and point a again approaches. In FIG. 11(5), the spring bolt means 30 has been released from point c and returned to the utmost stretched position by the force of the spring means 35 while the helical body 1 is being further turned.

When the helical body 1 has penetrated deep enough into the cork and come to its lowest position in the housing means 5, the cork shall start to move up along the helical body 1 so long as the helical body 1 continues being turned clockwise while staying at its lowest position. The cork, while moving up, shall abut and shove on the centering means 10 to move the centering means 10 up along with the cork. In the meantime, the spring bolt means 30 shall still be periodically pushed down into the opening 34 by the helical body 1 until the cork is extracted from the bottle into the housing means. The centering means 10 at this moment has been shoved by the cork to move up to the position nearly to abut the flange means 4 of the shaft means 2. Thus, the extraction of the cork from the bottle has been completed.

Figure 12:
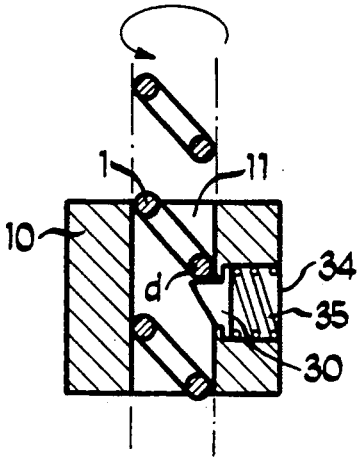
FIG. 12 shows the one-way driving function of the embodiment in FIG. 11 as the helical body (1) is being turned counter-clockwise.

The function of the spring bolt means 30 for extrusion of the cork from the housing means 5 is similar to that of the pawl-like means 20 described above. In particular, while the helical body 1 is simply being turned counter-clockwise by means of the handle means 3, as shown in FIG. 12, the spring bolt means 30 is not pushed down into the opening 34 because the helical body 1 is blocked upon some point thereof by the spring bolt means 30 in its utmost stretched position. This is something like the function of the spring bolt of a door lock installed in the door. In this way, while the helical body 1 continues being turned counter-clockwise, owing to the blocking of the spring bolt means 30, the centering means 10 shall be driven down with the spring bolt means 30 abutting against the downside of the helical body 1 and shall shove on the cork to extrude it from the housing means 5. Continued turning of the helical body 1 counter-clockwise shall cause the centering means 10 to drive the cork along the helical body 1, and the cork shall be extruded from the housing means 5 and drop off.

By means of the spring bolt means 30, no matter whether the helical body 1 is axially immobile while being turned clockwise at some position or is moving down while being turned clockwise to pierce into the cork, the centering means 10 shall never be driven to move up by the clockwise turned helical body 1 and shall only be moved up by the upwardly-moving cork per se, so that the gap between the centering means 10 and the cork shall be certainly avoided. Thus, the spring bolt means 30 functions as the ratcheting one-way driving means and attains the objects of the present invention as well.

While the invention has been particularly shown and described with reference to preferred embodiments thereof, it will be understood by those skilled in the art that the foregoing and other changes in form and details can be made therein without departing from the spirit and scope of the invention, which is therefore to be determined solely by the following claims.

What is claimed is:

1. A corkscrew for extracting a cork from a bottle, having a helical body including a fixed end and a free end being a pointed tip for piercing into said cork, a shaft means with the axis thereof being aligned with the axis of said corkscrew and said fixed end of said helical body being co-axially secured at the lower end of said shaft means, a handle means being fixed to upper end of said shaft means, a flange means being formed at the lower end of said shaft means for retaining said shaft means, a housing means including a bottle-engaging means at the lower end thereof for being emplaced on the mouth of the corked bottle, a guide means at the upper end thereof for guiding said shaft means co-axially moving up and down, a support means at the lower portion thereof for supporting a centering means thereon, and sharp-edged ribs integrally formed with the inner circumference of said support means for preventing rotation of the cork being extracted from the bottle into the housing means, the internal wall of said housing means being shaped to fit the configuration of said centering means for preventing from rotation of said centering means, said centering means comprising a central passageway extending substantially coaxial with the axis of said helical body there through for receiving said helical body passing slidably through, and a ratcheting one-way driving means for driving said centering means to move along said helical body only while said helical body is being turned in a predetermined direction.

2. A corkscrew as claimed in claim 1, wherein said ratcheting one-way driving means comprises a pawl-like means having an angled surface at one end and a retaining pivot means at the other end thereof, an opening provided at the wall of said passageway for receiving the pawl-like means, a pivot bearing provided in said opening for pivotally engaging with said retaining pivot means of said pawl-like means, and a spring means provided in said opening for keeping said pawl-like means normally stretched out to the utmost stretched position.

3. A corkscrew as claimed in claim 1, wherein said ratcheting one-way driving means comprises a spring bolt means having an angled surface at one end and a retaining means at the other end thereof, an opening provided at the wall of said passageway for receiving the spring bolt means, a shoulder means provided at the inner end of said opening for engaging the retaining means of said spring bolt means, and a spring means provided in said opening for keeping said spring bolt means normally stretched out to the utmost stretched position.

* * * * *

UNITED STATES PATENT AND TRADEMARK OFFICE

CERTIFICATE OF CORRECTION

PATENT NO. : 5,220,855

DATED : June 22, 1993

INVENTOR(S) : Leung et al.

It is certified that error appears in the above-identified patent and that said Letters Patent is hereby corrected as shown below:

| | |
|---|---|
| Col. 1, line 64 | Delete "remain" insert -- remains --. |
| Col. 2, line 7 | After "(slippage", delete ")". |
| Col. 2, line 8 | After "neck" insert -- ) --. |
| Col. 2, line 34 | After "objects" insert -- , --. |
| Col. 4, line 65 | After "24" insert -- , held --. |
| Col. 5, line 43 | Delete "counterclockwise" and insert -- counter-clockwise --. |
| Col. 6, line 2 | Delete "upwardly by the upwardly up" and insert -- up by the upwardly --. |

Signed and Sealed this

Nineteenth Day of April, 1994

Bruce Lehman

*Attest:*

BRUCE LEHMAN

*Attesting Officer*

*Commissioner of Patents and Trademarks*